United States Patent [19]

Gilbert

[11] 4,348,976

[45] Sep. 14, 1982

[54] DIVER TOW COMPRESSOR UNIT

[76] Inventor: Donald R. Gilbert, 58 McNeill St., Encinitas, Calif. 92024

[21] Appl. No.: 129,605

[22] Filed: Mar. 11, 1980

[51] Int. Cl.[3] ..... B63C 11/46

[52] U.S. Cl. ..... 114/270; 114/315; 128/202.13; 440/38

[58] Field of Search ..... 114/315, 270; 440/38; 128/202.13, 202.14

[56] References Cited

U.S. PATENT DOCUMENTS

| | | | |
|---|---|---|---|
| 3,369,518 | 2/1968 | Jacobson | 114/270 |
| 3,400,680 | 9/1968 | Taylor | 114/315 |
| 3,420,202 | 1/1969 | Oversmith | 114/315 |
| 3,630,165 | 12/1971 | Bottger | 114/315 |
| 3,957,007 | 5/1976 | Thomas | 114/315 |
| 4,166,462 | 9/1979 | Ellis | 114/315 X |
| 4,220,110 | 9/1980 | Roberson, Sr. et al. | 114/315 |

FOREIGN PATENT DOCUMENTS

| | | | |
|---|---|---|---|
| 734073 | 10/1932 | France | 440/38 |

*Primary Examiner*—Kathleen J. Prunner
*Attorney, Agent, or Firm*—Frank D. Gilliam

[57] ABSTRACT

A floating vessel that is propelled through the water by means of a water pump towing a diver or divers to a desired location, and then converting to an air-pump that delivers air through hoses to divers below. The hull is of fiberglass construction, and designed to be self-righting and water tight. The unit is powered by a three to five horsepower gasoline engine.

5 Claims, 7 Drawing Figures

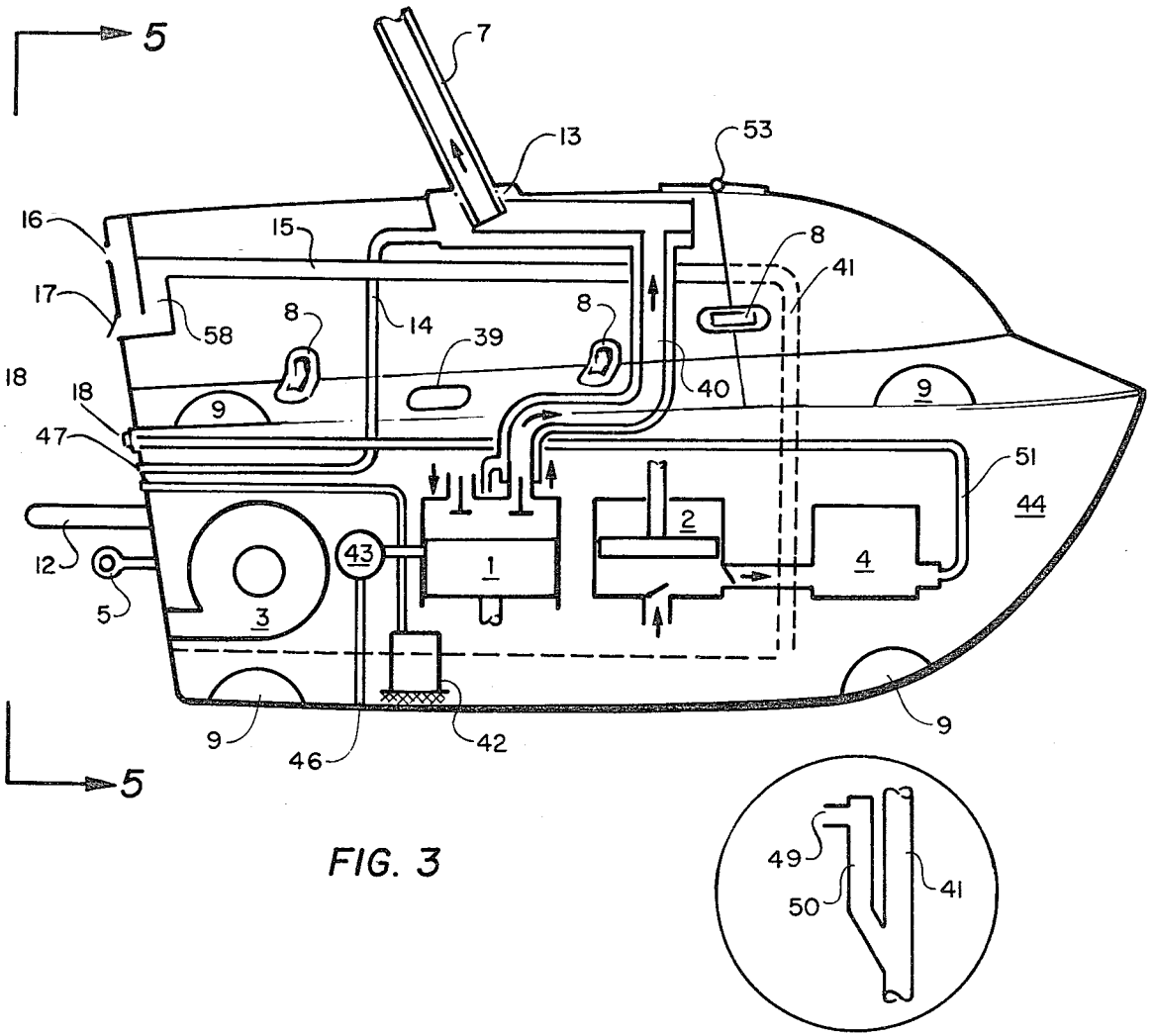
FIG. 3
FIG. 6
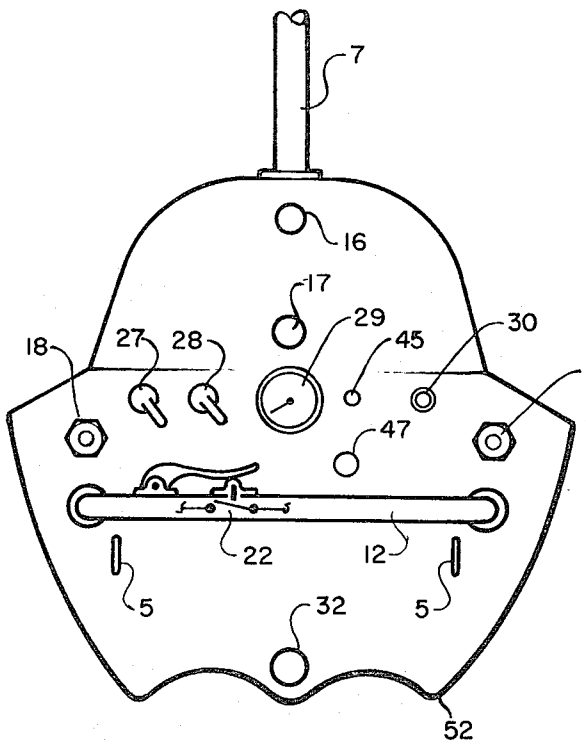
FIG. 5

DIVER TOW COMPRESSOR UNIT

SUMMARY OF THE INVENTION

The present vessel relates to a floating unit of light weight construction that can tow a diver or divers to a location and convert to a compressor that delivers from four to six hours of continuous low pressure air to divers below. The unit's compactness allows two people to easily manage the unit from the trunk of a car. The light weight, water cooled gasoline engine powers the centrifugal water pump for propulsion and the air compressor. Both the water pump and the air compressor are activated by electromagnetic clutches as shown in the drawings. A relay that is spring-loaded to the compressor mode assures against an accidental runaway. The air intake system is designed to allow minimum water to enter the unit. If water does enter the unit, it goes to the bilge, where it is removed by an automatic bilge pump. For ease of maintenance, the top is removed, and both pumps and the engine are lifted from the unit.

In comparison with a standard seventy-two cubic foot diving tank, the diver tow compressor unit (D.T.C.U.) will deliver four to six hours of air as compared to one hour of air at 60 feet with a 72 cu. ft. tank, and it propels the diver to the desired location, reserving his energy for under water. To travel to a remote area with tanks, one has to carry a high pressure compressor to fill the tanks; with the D.T.C.U., this is not required. The advantage over the present floating compressors is that the D.T.C.U. is water-tight, which allows operation of the D.T.C.U. in and through the surf operation and will propel the diver to the desired location.

DESCRIPTION OF DRAWINGS

FIG. 3 is a detailed description of the D.T.C.U. of FIGS. 1 and 2, showing the fresh air intake system;

FIG. 5 shows the gauges, controls, air connections and the basic design of the stern taken along line 5—5 of FIG. 3;

FIG. 6 shows the fresh air intake system for the compressor; and

DESCRIPTION OF A PREFERRED EMBODIMENT

Figure 4:
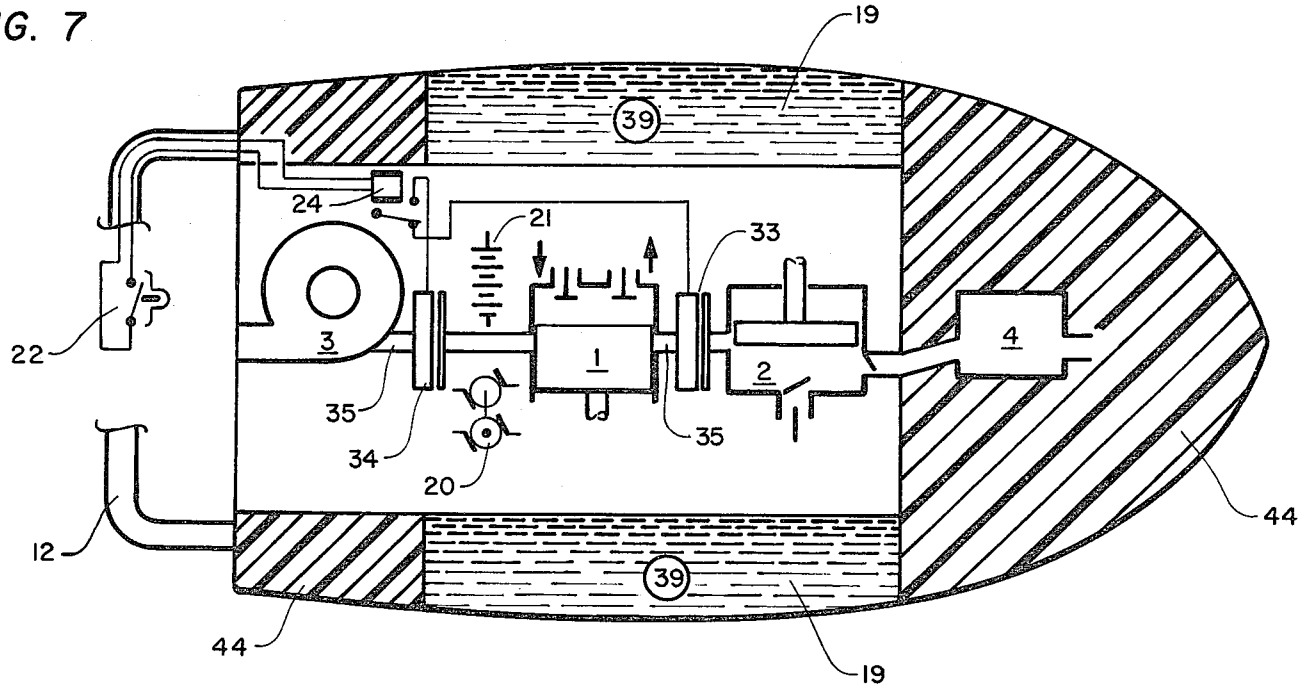
FIG. 4 is a cutaway plan view of the D.T.C.U., showing the basic layout of the various systems, compartments, some filled with polyurethane.

Referring now to the various figures, in FIG. 4, there is shown a four cycle engine 1 turning a drive shaft 35 with electromagnetic clutches 34 and 33, allowing separate operation of the centrifugal water pump 3, and the air compressor 2. A relay switch 24 allows only separate operation of either the water pump 3 or the air compressor 2. A hand switch 22 controls the switch 24 and is spring-loaded to the off position, and is actuated by a person's grip on the steer bar 12. Hence, the switch 22 prevents an accidental runaway. The starter generator 20 serves the purpose of starting the engine 1 and charging the starting battery 21 for future engine starting power The fuel pump for the four cycle engine 1 will be part of the carburetor working off the pulsating manifold pressure of the engine.

Figure 7:
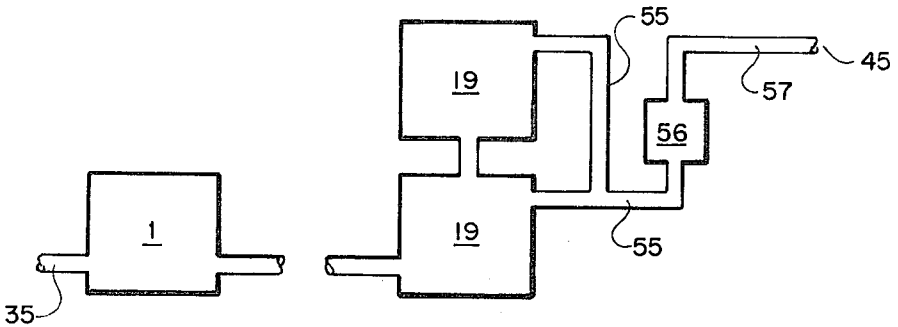
FIG. 7 shows the fuel venting system.

The slightest odor of gasoline in the breathing air would necessitate the diver surfacing. To alleviate the possibility of fuel overflowing from the fuel tanks 19 through 5 the fuel tank vent 45 (FIG. 5) and entering the air intake 16, fuel trap 56 (FIG. 7) with vent lines 55 coming from the fuel tanks and vent line 57 exiting through the vent hole 45 (FIG. 5) is installed above the height of the fuel tanks in the upper portion of compartment 44 (FIG. 3). Fuel is supplied to the fuel tanks 19 through filler openings 39 normally sealed by a water-tight lid.

Referring now to FIG. 3, cooling water enters the unit at opening 46 and goes through a mechanical water pump 43, then enters and cools the engine 1, then exists the engine and enters the jacketed portion of the flexible jacketed engine exhaust hose 40; the water then cools the exhaust manifold 13, and exits the unit through hose 14, and is discharged from opening 47. This heated water can be tapped and used to warm a chilled diver.

Still in reference to FIG. 3, air for the unit enters at opening 16, (a slight overhang directly above this opening prevents falling water from entering the unit), a one way valve 17 allows water to escape from the water trap 58, air then travels through tube 15, and enters tube 41. If by chance during possible submersion water does enter the unit, an automatic bilge pump 42 will empty any excess water. Carburetor air is taken from free air inside the unit. Air for the compressor 2 is taken from exit 49 (FIG. 6), the air trap 50 narrows the possibility of any water or noxious gas from the engine to enter the compressor. Air trap 50 is an upward extension of the air tube 41 that goes to the bilge. Air taken from point 49 is then compressed by the air compressor 2; it then travels to the volume tank 4, then through tube 51, and exits through the hollow male quick-disconnect hose fitting 18 into diver-connected breathing air supply hose 6.

Now in reference to FIG. 5: first to be noted is the general design of the stern. Ridge 52 extends along the base of the hull and serves the purpose of allowing the unit to stand and be dragged in an upright position. Minimum displacement in the lower portion of the unit and the location of the heavier components produce a low center of gravity. This gives the unit its self-righting capabilities. To eliminate stress on the arms, eyebolts 5 allow attachment of a tow line with T-bar 11 shown in FIG. 1.

Referring now to FIG. 5, the hollow hose quick disconnects 18 provide the diver air. The choke 27, the throttle 28 and the starting button 30 provides engine controls; fuel vent 45 vents the fuel tanks; air pressure gauge 29 indicates air pressure; and air intake hole 16 gives air for the engine and the compressor. The exhaust 7 directs the exhaust gases up and out of the way of the air intake 16. A hand switch 22, spring-loaded to the off position, activates the water pump. The water which provides propulsion by exiting high pressure water from the pump out exit opening 32, well known in the art.

Figure 1:
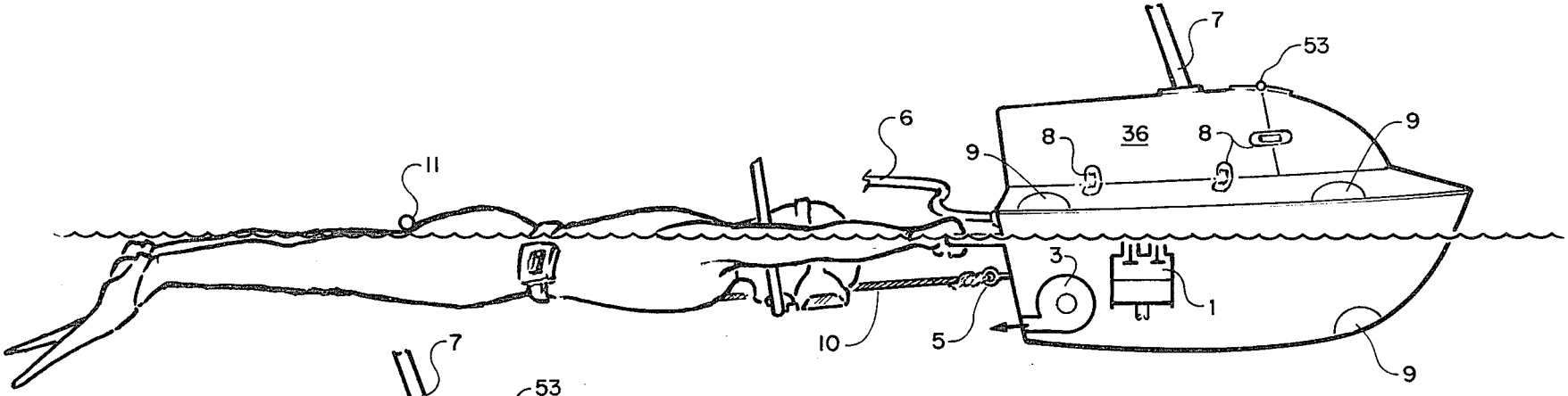
FIG. 1 depicts a diver being towed by the D.T.C.U. with the unit in its propulsion mode.
Figure 2:
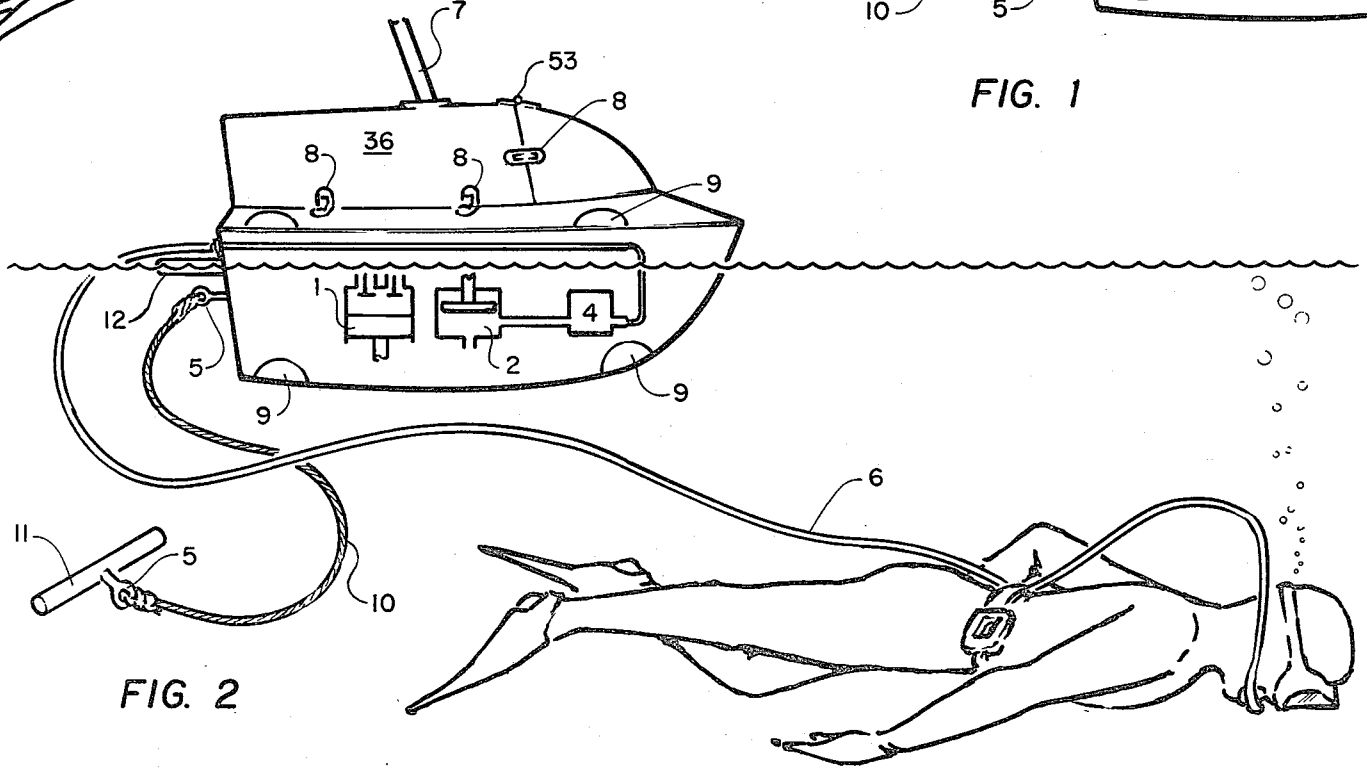
FIG. 2 depicts the unit in the compressor mode supplying air to a diver.

Now in reference to FIG. 1 and FIG. 2 a water-tight cowling 36 is secured in place to the main unit by latches 8 and hinge 53 allows the cowling to pivot upward for access to the unit. FIG. 1 shows the unit in the propulsion mode. To be noted is the T-bar 11 that is situated below the buttocks of the diver. The diver basically sits on the T-bar with rope 10 passing between the legs and is hauled out to sea, rather than dragged out. FIG. 2 basically shows the D.T.C.U. in the compressor mode; with the diver free from the T-bar 11 under water.

Convenient handles 9 are provided at various locations on the D.T.C.U. for manually handling and transporting the unit out of the water.

Having thus described a preferred embodiment of the invention, what is claimed is:

1. A floating vessel of lightweight construction, operable to tow divers, comprising:

a. a hull having a stern;

b. a power plant disposed within the hull;

c. a propulsion means mounted to be driven by said power plant through a first clutch;

d. an air compressor mounted to be driven by said power plant through a second clutch;

e. switching means connected to said clutches to activate operation of said propulsion means while deactivating said air compressor and to activate said air compressor while deactivating said propulsion means;

f. a steer bar disposed on the exterior of the stern and projecting outwardly away from the hull so as to enable a diver to grasp onto and steer the hull;

g. control means for the power plant being disposed on the exterior of the stern so that the diver has ready access thereto; and h. hand actuated control means for said switching means being disposed on said steer bar so as to enable the diver to operate said switching means.

2. A floating vessel according to claim 1, wherein said propulsion means comprises a water pump.

3. A floating vessel according to claim 1, wherein said power plant comprises a gasoline engine, and further including a fuel tank disposed in the hull and operatively connected to said engine, said fuel tank having a fuel vent trap so as to eliminate the possibility of fuel spillage.

4. A floating vessel according to claim 1, further including a T-bar disposed on the exterior of the stern and projecting outwardly away from the hull a distance greater than said steer bar so as to provide a seat for the diver and enable the diver to be hauled rather than dragged.

5. A floating vessel according to claim 1, wherein said clutches are electromagnetic.

* * * * *